US006296051B1

(12) United States Patent
Sahnoun et al.

(10) Patent No.: US 6,296,051 B1
(45) Date of Patent: Oct. 2, 2001

(54) HEAT EXCHANGER WITH REDUCED SPACE REQUIREMENT, IN PARTICULAR FOR MOTOR VEHICLE

(75) Inventors: Abdel-Jalil Sahnoun, Guyancourt; Christian Mahe, Le Tremblay sur Mauldre, both of (FR)

(73) Assignee: Valeo Termique Moteur, La Verriere Cedex (FR)

( * ) Notice: Subject to any disclaimer, the term of this patent is extended or adjusted under 35 U.S.C. 154(b) by 0 days.

(21) Appl. No.: 09/555,232

(22) PCT Filed: Sep. 24, 1999

(86) PCT No.: PCT/FR99/02285

§ 371 Date: May 25, 2000

§ 102(e) Date: May 25, 2000

(87) PCT Pub. No.: WO00/19163

PCT Pub. Date: Apr. 6, 2000

(30) Foreign Application Priority Data

Sep. 25, 1998 (FR) ..... 98 12031

(51) Int. Cl.[7] ..... F28F 9/02; F28D 1/02

(52) U.S. Cl. ..... 165/173; 165/175; 165/153

(58) Field of Search ..... 165/173, 172, 165/174, 175, 149, 153

(56) References Cited

U.S. PATENT DOCUMENTS

| | | | | |
|---|---|---|---|---|
| 3,415,315 | | 12/1968 | Donaldson et al. . | |
| 4,401,157 | * | 8/1983 | Cadars | 165/173 |
| 4,582,127 | * | 4/1986 | Moranne | 165/173 |
| 5,123,482 | * | 6/1992 | Abraham | 165/173 |
| 5,219,024 | * | 6/1993 | Potier | 165/173 |
| 5,311,934 | * | 5/1994 | Potier | 165/173 |
| 5,355,944 | * | 10/1994 | Potier | 165/173 |
| 5,431,218 | * | 7/1995 | Lelievre | 165/173 |
| 5,901,784 | * | 5/1999 | Potier | 165/173 |

FOREIGN PATENT DOCUMENTS

| | | |
|---|---|---|
| 0 334 817 | 9/1989 | (EP) . |
| 0 372 187 | 6/1990 | (EP) . |
| 2 031 669 | 11/1970 | (FR) . |
| 2 549 614 | 8/1984 | (FR) . |
| 2 742 528 | 7/1997 | (FR) . |

* cited by examiner

*Primary Examiner*—Ira S. Lazarus
*Assistant Examiner*—Tho Van Duong
(74) *Attorney, Agent, or Firm*—Morgan & Finnegan, LLP

(57) ABSTRACT

The invention concerns a heat exchanger, in particular for a motor vehicle, comprising an array of tubes and fins, whereof the ends of the tubes are inserted in holes of a collector plate. The latter is generally planar and an inserting plate is arranged, directly mounted on the collector plate and provided with openings for allowing through the ends of the tubes and delimited by a peripheral edge forming a lateral stop for a rim of a manifold maintained by crimping means.

17 Claims, 1 Drawing Sheet

HEAT EXCHANGER WITH REDUCED SPACE REQUIREMENT, IN PARTICULAR FOR MOTOR VEHICLE

BACKGROUND OF THE INVENTION

The invention relates to heat exchangers, in particular for motor vehicles.

It concerns more particularly a heat exchanger of the type comprising a bundle of tubes and of fins, in which the ends of the tubes are introduced into the holes of a manifold plate, as well as a manifold box having an open face delimited by a peripheral rim, and in which heat exchanger the manifold plate is provided with crimping means suitable for coming to bear against the peripheral rim of the manifold box while compressing a sealing gasket.

Heat exchangers of this type are already known, which are used in motor vehicles, in particular in order to cool the engine or heat the passenger compartment.

In known heat exchangers of this type, the manifold plate is usually provided with collars through which the ends of the tubes of the bundle pass.

Distinction is made between two main types of heat exchangers: exchangers of the mechanically assembled type, and exchangers of the brazed type.

In the first case, the ends of the tubes are received in the collars of the manifold plate with the insertion of corresponding collars forming part of the sealing gasket. The collars of the sealing gasket are compressed by widening of the tubes.

In the second case, the ends of the tubes are received directly in the collars of the manifold plate, and are brazed to it.

The sealing between the manifold plate and the manifold box is ensured by the sealing gasket's perimeter, which is received in a peripheral groove of the manifold plate that forms a kind of gutter. This groove receives both the perimeter of the sealing gasket and the manifold box's rim, against which the crimping means of the manifold plate come to bear. These crimping means may be produced, for example, in the form of tongues folded against the rim of the manifold box.

The presence of this peripheral groove has hitherto been indispensable in order to make it possible both to accommodate the perimeter of the sealing gasket, as well as the rim of the manifold box, and to hold this rim during the crimping operation. This is because, without the presence of this groove, the peripheral rim of the manifold box would tend to move inward under the effect of the high pressures which are exerted during the crimping operation.

However, the presence of this groove, which surrounds a generally flat bottom of the manifold plate, increases the space requirement, especially the width requirement, of the heat exchanger. This is because the space requirement of the manifold plate proper is much greater than that of the bundle, which is usually defined by the fins.

In current vehicles, however, the space allocated to the equipment is increasingly limited, and it is found necessary to be able to reduce the space requirement of the heat exchangers, while retaining comparable thermal performance.

BRIEF SUMMARY OF THE INVENTION

The object of the invention is to afford a solution to this problem.

To that end, it proposes a heat exchanger of the type defined in the introduction, in which the manifold plate is generally plane, and in which an insertion plate is mounted on the manifold plate on the side next to the manifold box, this insertion plate being provided with openings for the ends of the tubes to pass through and being delimited by a peripheral rim forming a lateral stop for the rim of the manifold box.

Hence, the manifold plate of the exchanger of the invention is plane and is without a peripheral groove, which makes it possible to limit its space requirement compared with known manifold plates that are provided with a peripheral groove.

The insertion plate, which is mounted on the manifold plate, gives a lateral stop for the rim of the manifold box, so that this rim is held laterally during the crimping operation.

Another advantage of this insertion plate is that it allows flush fitting of the ends of the tubes which, previously, protruded into the volume delimited jointly by the manifold plate and the manifold box. This leads to a significant reduction of the pressure head loss associated with the admission of a fluid, in particular a coolant, into the tubes of the heat exchanger.

Further, the presence of this insertion plate makes it possible to reduce the internal volume delimited by the manifold box and the manifold plate, and therefore the mass of the fluid flowing through the heat exchanger.

According to one advantageous characteristic of the invention, the peripheral rim of the manifold box internally delimits a peripheral recess suitable for allowing flush fitting of the peripheral edge of the insertion plate in order to hold it in position.

Preferably, the openings of the insertion plate are arranged in front of the ends of the tubes, and they each have an edge which is widened in the direction of the manifold box in order to favor the admission of a fluid into the tubes.

The insertion plate is advantageously made of plastic.

According to another characteristic of the invention, the sealing gasket is suitable for being accommodated between the manifold plate, on the one hand, and the rim of the manifold box as well as the insertion plate, on the other.

In one embodiment of the invention, the ends of the tubes are received in collars of the manifold plate while compressing corresponding collars of the sealing gasket, which makes it possible to carry out assembly of the mechanical type.

In this case, the ends of the tubes form widenings received in the openings of the insertion plate.

In a heat exchanger of this type, it is advantageous to supply a protective plate which is placed between the manifold plate and the fins of the bundle in order to protect the collars of the sealing gasket.

This is because, without the presence of this protective means, the parts of the collars of the sealing gasket which protrude on the side next to the bundle could be damaged by external agents.

In another embodiment of the invention, the ends of the tubes are received and brazed in collars of the manifold plate in order to give an assembly of the brazed type.

BRIEF DESCRIPTION OF THE DRAWINGS

In the following description, which is provided by way of example, reference is made to the appended drawing, in which.

DETAILED DESCRIPTION OF THE INVENTION

Figure 1:
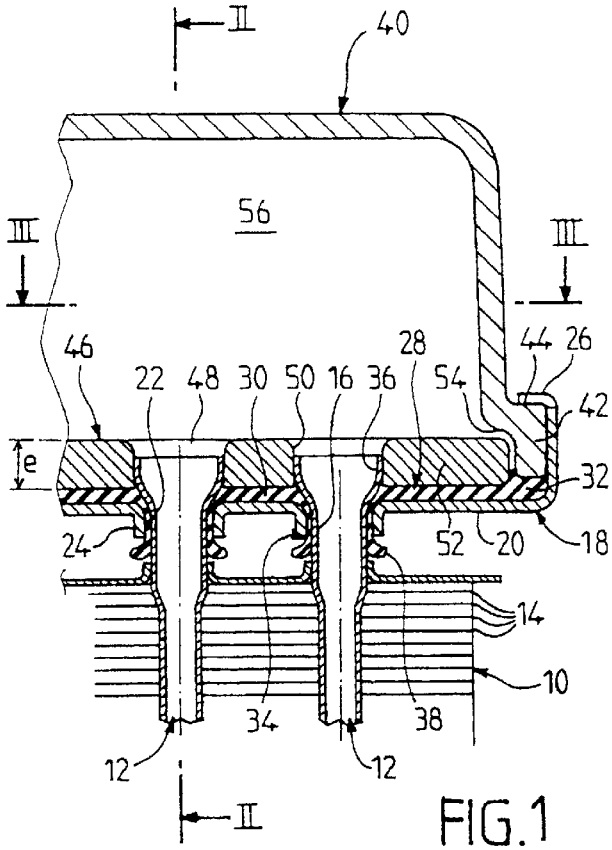
FIG. 1 is a view in partial longitudinal section of a heat exchanger of the mechanically assembled type according to the invention.
Figure 2:
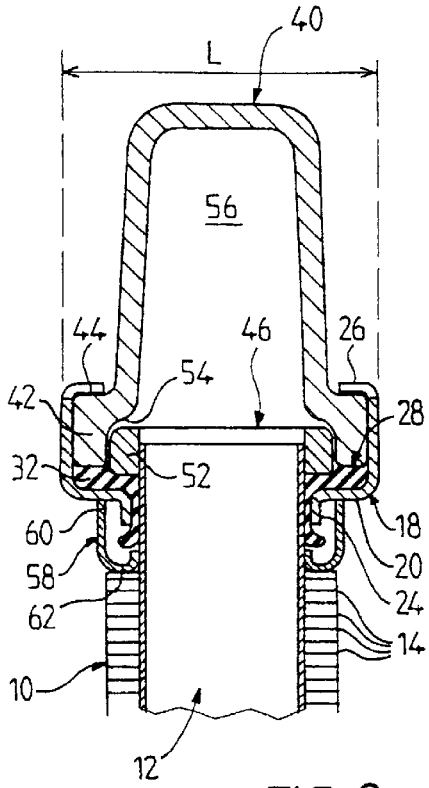
FIG. 2 is a partial view in section along the line II—II in FIG. 1.
Figure 3:
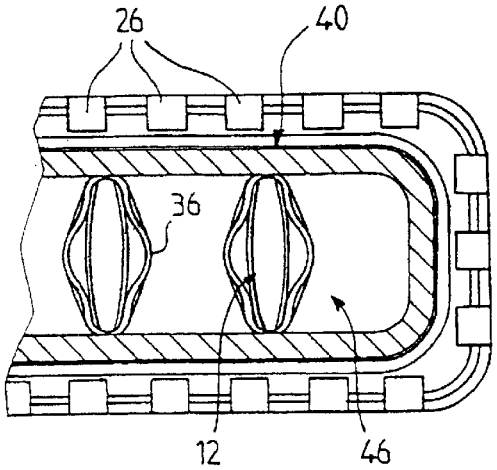
FIG. 3 is a view in partial section along the line III—III in FIG. 1.

The heat exchanger represented in FIGS. 1 to 3 comprises a bundle 10 formed by a multiplicity of tubes 12 that have a cross section of flattened oval shape and are arranged parallel to one another on a single row. The tubes 12. pass through a multiplicity of fins 14 consisting of metal plates that are rectangular and parallel to one another. Each tube 12 has a free end 16 assembled mechanically with a manifold plate 18, also referred to as a "manifold".

Before the tubes and the manifold plate are assembled, the ends 16 of the tubes have exactly the same cross section as the tubes, in the running part of the latter which receives the fins 14.

The plate 18 comprises a plane web 20 of rectangular general shape in which holes 22 of oval cross section, which are suitable for receiving the ends 16 of the tubes 12, are formed. Each hole 22 is surrounded by a collar 24 positioned toward the side next to the fins 14.

The web 20 of the manifold plate 18 is folded on its perimeter in order to formed crimping tongues 26, which resemble teeth or notches and can be folded, as will be seen further on.

On its face on the opposite side from the bundle, the manifold plate 18 receives a compressible sealing gasket 28 which comprises a web 30 suitable for being applied against the web 20 of the manifold plate. This web 30 is plane and has a perimeter 32 which extends as far as the inner perimeter of the manifold plate 18, as delimited by the crimping tongues 26.

The sealing gasket 28 is formed with a multiplicity of collars 34 which are arranged in correspondence with the collars 24 of the manifold plate 18. Each of these collars 34 is suitable for ensuring the sealing between the end 16 of a tube and the corresponding collar 24 of the manifold plate. This sealing is ensured by expanding the end 16 of each tube in order to give a widening 36 (FIGS. 1 and 3) ensuring the sealing. Each of the collars 34 hence has a bead 38 which extends beyond the collar 24 on the side next to the fins 14 of the bundle.

The heat exchanger further comprises a manifold box 40, advantageously made of plastic, and having an open face of rectangular general shape delimited by a peripheral rim 42. This peripheral rim is suitable for coming to bear against the perimeter 32 of the gasket 28 and for compressing the gasket during a crimping operation. This operation, carried out using a suitable tool, allows the tongues 26 to be folded against an annular face 44 of the rim 32.

In contrast to known manifold plates, the manifold plate 18 of the invention does not include a peripheral groove for receiving the perimeter 32 of the gasket 28 and the peripheral rim 42 of the manifold plate.

According to the invention, the heat exchanger further comprises an insertion plate 46 which is mounted on the manifold plate 18, on the side next to the manifold box 40. In reality, this insertion plate 46 is applied against the sealing gasket 28, and more particularly against the web 30 of the gasket. This insertion plate has a shape similar to that of the manifold plate 18. It includes openings 48 of substantially oval cross section for allowing the ends 16 of the tubes and the corresponding widenings 36 to pass through.

The insertion plate 46 is a thickness e (FIG. 1) which is more than the height of the ends 16 that project on the side next to the manifold box 40, which allows the widened ends to be flush-fitted in the aforementioned openings 48, which have a widened edge 50 turned toward the manifold box.

The insertion plate 46 is delimited by a peripheral edge 52, of rectangular general shape, which forms a lateral stop for the rim 42 of the manifold box.

The latter internally delimits a peripheral recess 44, of rectangular general contour, suitable for allowing flush fitting of the peripheral edge 52 of the insertion plate. The result is that this insertion plate is held in position inside the volume 56 delimited in the manifold box 40. It should be noted that it is not necessary for the insertion plate 46 to compress the web 30 of the gasket, since this part of the gasket does not contribute directly to the sealing.

The insertion plate 46 is advantageously made of plastic, preferably of the same type as that forming the manifold box 40.

The heat exchanger in FIGS. 1 to 3 further includes a protective plate 58 (FIGS. 1 and 2), which has a U-shaped general profile and which includes one edge 60 suitable for bearing externally against the web 20 of the manifold plate 18 and a folded opposite edge 62 suitable for bearing against the first fin 14 of the bundle.

This plate makes it possible to protect the beads 38 of the sealing gasket, as well as the ends of the tubes in the region of the beads. It further makes it possible to ensure a separation of chosen value between the first fin of the bundle and the manifold plate 18.

The manufacture of the heat exchanger in FIGS. 1 to 3 takes place in the usual way for an exchanger of the mechanically assembled type. After having been equipped with the gasket, the manifold plate 18 receives the ends 16 of the tubes, which are then widened in order to compress the collars 34. The insertion plate 46 is put in place on the manifold plate 18 either before or after the ends of the tubes are widened.

The manifold box 40 is then put in place so that its rim 42 is accommodated in the annular space, delimited internally by the peripheral edge 52 of the insertion plate and externally by the crimping tongues 26, which are not folded.

After this, the crimping operation is carried out while folding the tongues 26, which compresses the perimeter 32 of the sealing gasket. During this operation, the insertion plate 46 supplies a lateral stop for the rim 42 of the manifold box, and this avoids any deformation or any untimely movement of this rim 42, which could cause a sealing defect.

The invention makes it possible to produce a heat exchanger in which the dimensions of the manifold plate 18, in particular its width L (FIG. 2) is [sic] less than that of known heat exchangers in which the manifold plate 18 is provided with a peripheral groove. This is due to the fact that the manifold plate 18 is plane and receives an insertion plate 46 as defined above.

Further, the presence of this insertion plate makes it possible to limit the pressure head losses of the fluid which enters through the ends 16 of the tubes.

Figure 4:
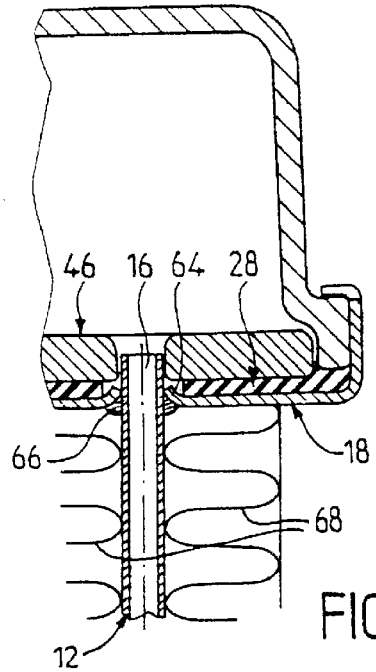
FIG. 4 is a view in partial section, similar to FIG. 1, in the case of a heat exchanger of the brazed type, produced according to the invention.

The embodiment of FIG. 4, to which reference will now be made, involves a heat exchanger of similar structure, in which the manifold plate 18 is without a peripheral groove.

Here again, an insertion plate 46 similar to the one described above is supplied. In this particular case, the manifold plate includes collars 64 which are positioned on the side next to the manifold plate and are suitable for allowing the ends 16 of the tubes to be inserted. In this case, these ends are brazed directly to the collars 64 by means of a brazing joint 66. The heat exchanger includes corrugated inserts 68 forming heat-exchange fins.

The invention is not limited to the embodiments described above by way of example, and extends to other variants. For example, the insertion plate could be made in several parts which are mounted on the manifold plate.

The heat exchanger of the invention has many applications, in particular in the automotive field. It may then be used, in particular, as a radiator for cooling the engine, or as a radiator for heating the passenger compartment.

What is claimed is:

1. A heat exchanger comprising:

a bundle of tubes and fins, a manifold plate, the tubes having ends that are introduced into holes of the manifold plate, a sealing gasket, a manifold box having an open face delimited by a peripheral rim, the manifold plate provided with crimping means that bears against the peripheral rim of the manifold box while compressing the sealing gasket, the manifold plate generally planar, and an insertion plate mounted on a side of the manifold plate next to the manifold box, the insertion plate having openings for the ends of the tubes to pass through, the openings of the insertion plate arranged in front of the ends of the tubes, each opening having an edge which is widened in the direction of the manifold box to favor admission of a fluid into the tubes, the insertion plate delimited by a peripheral edge forming a lateral stop without a groove for the peripheral rim of the manifold box.

2. A heat exchanger according to claim 1, wherein the peripheral rim of the manifold box internally delimits a peripheral recess suitable for flush fitting of the peripheral edge of the insertion plate.

3. A heat exchanger according to claim 1, wherein the insertion plate is made of plastic.

4. A heat exchanger according to claim 1, wherein the sealing gasket is accommodated between the manifold plate and the peripheral rim of the manifold box as well as the insertion plate.

5. A heat exchanger according to claim 1, wherein the manifold plate and the sealing gasket include corresponding collars, and wherein the ends of the tubes are received in the collars of the manifold plate while compressing the corresponding collars of the sealing gasket in order to form a heat exchanger of the mechanical type.

6. A heat exchanger according to claim 5, wherein the ends of the tubes form widenings received in the openings of the insertion plate.

7. A heat exchanger according to claim 5, wherein a protective plate is placed between the manifold plate and the fins of the bundle in order to protect the collars of the sealing gasket.

8. A heat exchanger according to claim 1, wherein the manifold plate and the sealing gasket include corresponding collars, and wherein the ends of the tubes are received and brazed in the collars of the manifold plate in order to form a heat exchanger of the brazed type.

9. A heat exchanger accordingly to claim 6, wherein a protective plate is placed between the manifold plate and the fins of the bundle in order to protect the collars of the sealing gasket.

10. A heat exchanger comprising:

a manifold box having a peripheral rim;

a sealing gasket;

a manifold plate having holes and a crimping tongue that bears against the peripheral rim while compressing the sealing gasket;

a bundle of tubes and fins, the tubes having ends positioned in the holes of the manifold plate; and an insertion plate mounted on the manifold plate proximate the manifold box, the insertion plate having openings through which the ends of the tubes pass, the openings of the insertion plate arranged in front of the ends of the tubes, each opening having an edge which is widened in the direction of the manifold box to favor admission of a fluid into the tubes, the insertion plate delimited by a peripheral edge that forms a lateral stop without a groove for the peripheral rim.

11. The heat exchanger according to claim 10 wherein the peripheral rim internally delimits a peripheral recess, the peripheral edge fitting flush in and held in position by the peripheral recess.

12. The heat exchanger according to claim 10 wherein the insertion plate is plastic.

13. The heat exchanger according to claim 10 wherein the sealing gasket is positioned between the manifold plate and one of the peripheral rim or the insertion plate.

14. The heat exchanger according to claim 10 wherein the manifold plate and the sealing gasket include corresponding collars, the ends of the tubes received in the collars of the manifold plate while compressing the corresponding collars of the sealing gasket to form a mechanical-type heat exchanger.

15. The heat exchanger according to claim 14 wherein the ends of the tubes form widenings that are received in the openings of the insertion plate.

16. The heat exchanger according to claim 14 wherein a protective plate is positioned between the manifold plate and the fins of the bundle to protect the collars of the sealing gasket.

17. The heat exchanger according to claim 10 wherein the ends of the tubes are received and brazed in the collars of the manifold plate to form a brazed-type heat exchanger.

* * * * *